US006831552B2

(12) United States Patent
Lin

(10) Patent No.: US 6,831,552 B2
(45) Date of Patent: Dec. 14, 2004

(54) VOCAL CONTAINER CAP

(76) Inventor: Ted Lin, No. 6, Lane 41, Minchiuan St., Taishan Shiang, Taipei (TW), 243

( * ) Notice: Subject to any disclaimer, the term of this patent is extended or adjusted under 35 U.S.C. 154(b) by 250 days.

(21) Appl. No.: 10/114,294

(22) Filed: Apr. 3, 2002

(65) Prior Publication Data

US 2003/0189494 A1 Oct. 9, 2003

(30) Foreign Application Priority Data

Jul. 26, 2001 (TW) ..... 90212707 U

(51) Int. Cl.[7] ..... G08B 3/10

(52) U.S. Cl. ..... 340/384.7; 340/692; 340/686; 215/200; 215/400

(58) Field of Search ..... 340/384.7, 692, 340/686; 215/316; 446/71

(56) References Cited

U.S. PATENT DOCUMENTS 4,801,929 A * 1/1989 Instance ..... 340/692
5,056,681 A * 10/1991 Howes ..... 220/522
5,625,347 A * 4/1997 MacLean et al. ..... 340/568.1
6,545,594 B1 * 4/2003 Knight et al. ..... 340/384.7

* cited by examiner

*Primary Examiner*—Jeffery Hofsass
*Assistant Examiner*—Eric Blount
(74) *Attorney, Agent, or Firm*—Troxell Law Office PLLC

(57) ABSTRACT

A vocal container cap includes a cap portion and a vocal assembly received in the cap portion. When the cap portion is fully closed onto a container mouth, an elastic switch associated with a movable member of the vocal assembly is pressed against a contact on a circuit board supported on a fixed member of the vocal assembly to disable the vocal container cap. And when the cap portion is twisted to loosen from the container mouth, a spring lifts the movable member to separate the elastic switch from the contact and thereby actuates the vocal container cap to sound or voice.

3 Claims, 5 Drawing Sheets

VOCAL CONTAINER CAP

BACKGROUND OF THE INVENTION

The present invention relates to a vocal container cap, and more particularly to a container cap that sounds or voices when it is loosened from a container mouth.

People frequently send cards or gifts to families and friends on special dates, such as Christmas, New Year, birthdays, etc., and greetings and congratulations are usually directly written on the cards.

In recent years, there are developed musical cards that give out a piece of music or voice of a sender when they are opened. In either case, the card sounds because an isolated thin strip internally attached to a folding line of the card is pulled when the card is opened. However, cards and gifts are only two of many ways for showing greetings and congratulations. Bottled good wines, such as champagne, are often adopted as presents for friends at special dates, too. It is a pity that a vocal mechanism similar to that employed for the musical cards is not applicable on bottled products.

SUMMARY OF THE INVENTION

It is therefore a primary object of the present invention to provide a vocal container cap that does not sound or voice when being fully closed on a container mouth, and gives out a piece of preset music, sound or voice when being loosened from the container mouth.

To achieve the above and other objects, the vocal container cap of the present invention mainly includes a hollow cap portion having a predetermined length and a vocal assembly received in the cap portion. The vocal assembly includes a movable member normally pushed upward against the cap portion by a spring, and a fixed member below the movable member to support a circuit board and batteries thereon. The fixed member also serves to internally seal the container mouth. When the cap portion is in a first position in which it is fully closed onto the container mouth, an elastic switch associated with the movable member of the vocal assembly is downward pressed against a contact on the circuit board supported on the fixed member of the vocal assembly to disable the vocal container cap. And when the cap portion is twisted to loosen from the container mouth and moves into a second position, the spring lifts the movable member to separate the elastic switch from the contact and thereby actuates the vocal container cap to sound or voice.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
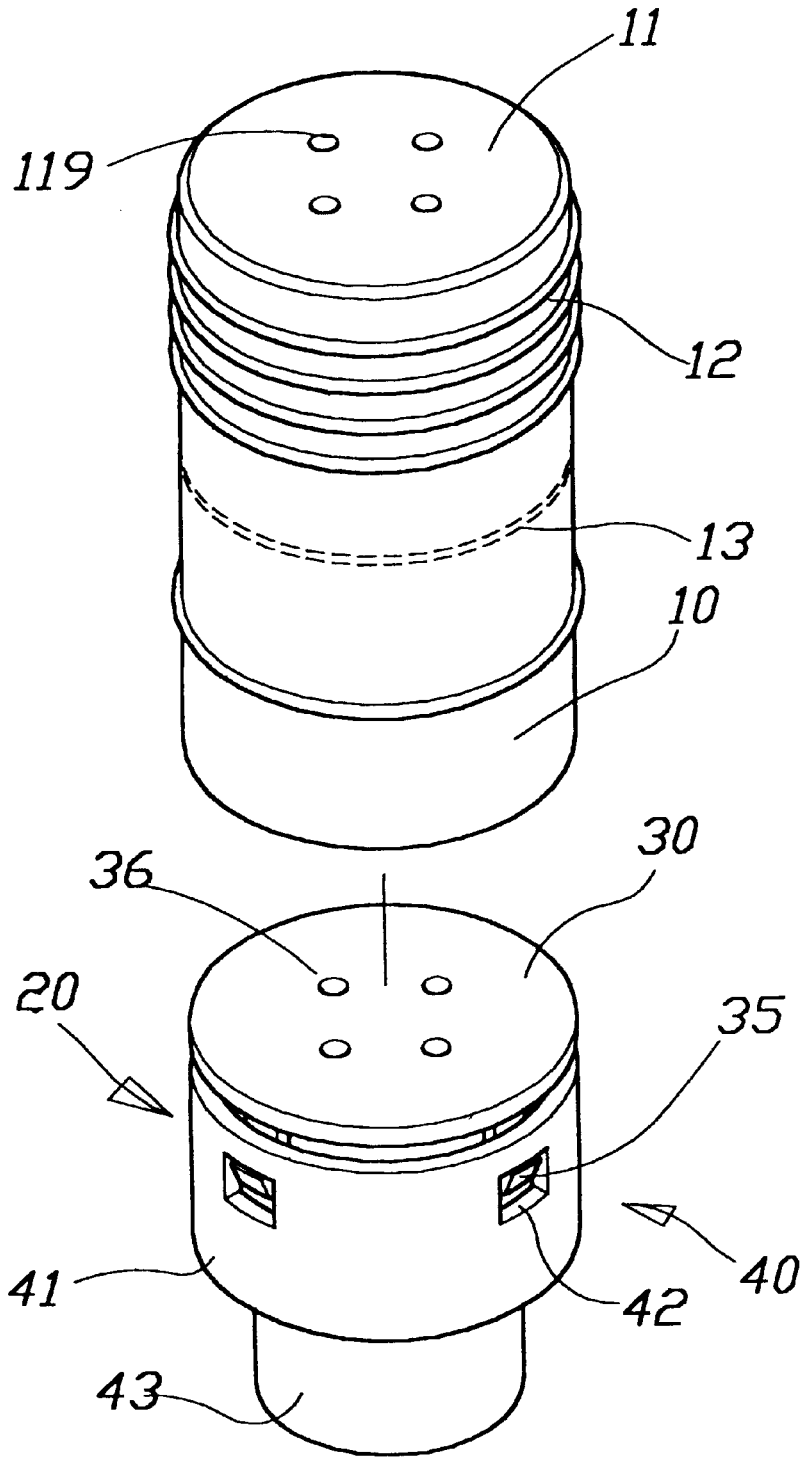
FIG. 1 is a partially exploded perspective view of a vocal container cap according to a preferred embodiment of the present invention.

Please refer to FIG. 1 that is a partially exploded perspective view of a vocal container cap according to a preferred embodiment of the present invention. The vocal container cap includes a hollow cap portion 10 made of a sheet metal material and having a predetermined length to define a solid top 11 and an open bottom, and a vocal assembly 20 fitted in the hollow cap portion 10. Usually, the cap portion 10 is provided at a distance below the solid top 11 with a threaded section 12 for engaging with external screw threads provided around a container mouth. And, for a large part of the cap portion 10 to separate from the container mouth easily when the cap portion 10 is twisted relative to the container mouth, a circle of weakened section 13 is provided slightly below the threaded section 12.

Figure 2:
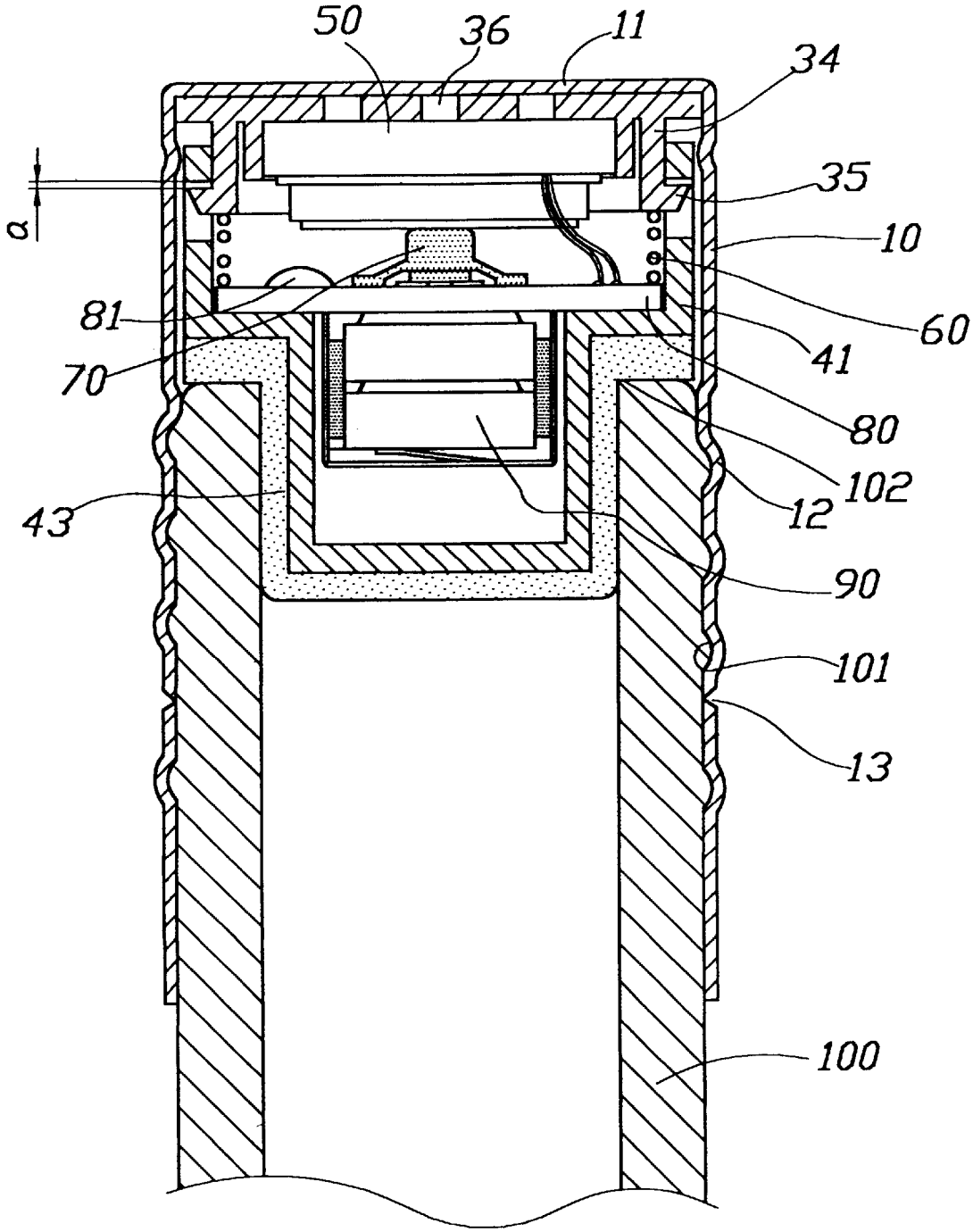
FIG. 2 is an assembled sectional view of the vocal container cap of the present invention fully closed onto a container mouth, wherein a vocal assembly thereof is disabled.
Figure 3:
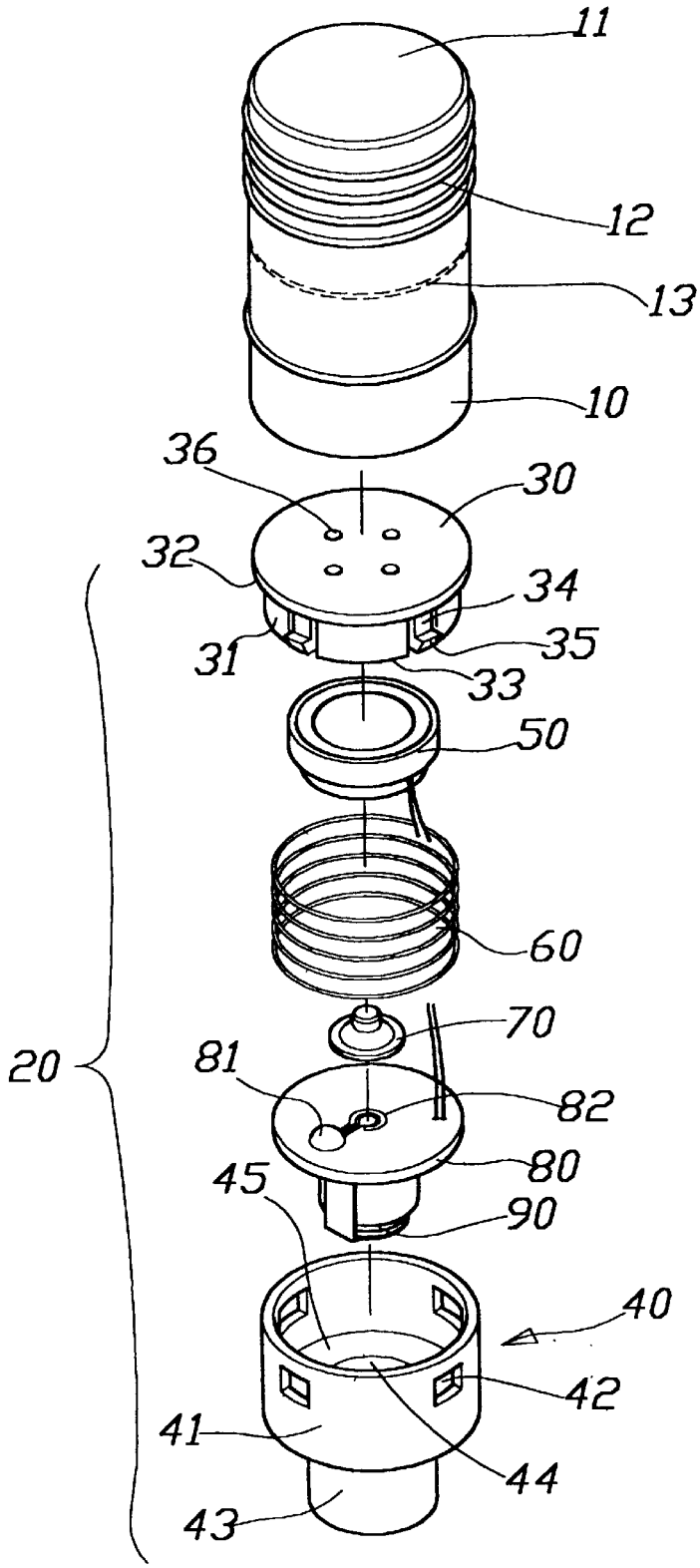
FIG. 3 is a fully exploded perspective view of the vocal container cap of the present invention.

Please refer to FIGS. 1 to 3 at the same time. The vocal assembly 20 includes a movable member 30, a fixed member 40 with which the movable member 30 is movably associated, and a mini speaker 50, a spring 60, an elastic switch 70, a circuit board 80, and batteries 90 sequentially mounted between the movable and the fixed members 30, 40 from top to bottom.

The fixed member 40 includes a large-diameter hollow ring portion 41 and a small-diameter hollow plunger portion 43 downward extended from a bottom of the ring portion 41 to define a reduced bore 44, such that a stepped surface 45 is formed in the fixed member 40 between the ring portion 41 and the plunger portion 43. The ring portion 41 is provided along a peripheral wall at a predetermined height with multiple spaced windows 42. The plunger portion 43 is dimensioned for internally sealing the container mouth.

The circuit board 80 is supported on the stepped surface 45 in the hollow ring portion 41 and has required circuits and related electronic components provided thereon. The batteries 90 are connected to a bottom of the circuit board 80 and located in the reduced bore 44. The electronic components on the circuit board 80 include an IC 81 and a contact 82. The elastic switch 70 located above the circuit board 80 is electrically connected at an internal conductive rubber pad to the contact 82 to control electrical connection of circuits on the circuit board 80. Since circuits for driving a music IC via a push switch is known in the art, it is not discussed in details herein. In the illustrated embodiment, the electrically conductive rubber pad in the elastic switch 70 normally contacts with the contact 82. And, when the elastic switch 70 is moved upward, one contact control is formed to actuate the IC 81 for the vocal container cap to sound for a predetermined period of time. There are also other feasible ways for the cap to sound. For example, another switch button may be provided below the elastic switch 70 to drive the related circuits. In the illustrated embodiment, the elastic switch 70 is normally in a first position that disables the vocal container cap, and moves into a second position when the cap portion 10 is turned open and thereby actuates the vocal container cap.

The movable member 30 includes a diameter-reduced peripheral wall portion 31 downward extended from a top of the movable member 30 by a predetermined distance, such that a shoulder portion 32 is formed between the top of the movable member 30 and the reduced peripheral wall portion 31, and a bottom of the reduced peripheral wall portion 31 defines a lower periphery edge 33 of the movable member 30. The mini speaker 50 is received in a space defined in the reduced peripheral wall portion 31 and connected to the circuit board 80 via wires. The reduced peripheral wall portion 31 is located in the ring portion 41 of the fixed member 40, and includes a plurality of spaced tongues 34 suspended from an underside of the shoulder portion 32 corresponding to the windows 42 on the ring portion 41 of the fixed member 40. Each of the suspended tongues 34 includes a hook 35 outward extended from a lower end thereof to project into the window 42 and thereby holds the movable member 30 to the fixed member 40. The cap portion 10 and the movable member 30 are provided on their tops with a plurality of through holes 119 and 36, respectively, to facilitate transmission of voice or sound from the mini speaker 50 in the reduced peripheral wall portion 31.

Figure 4:
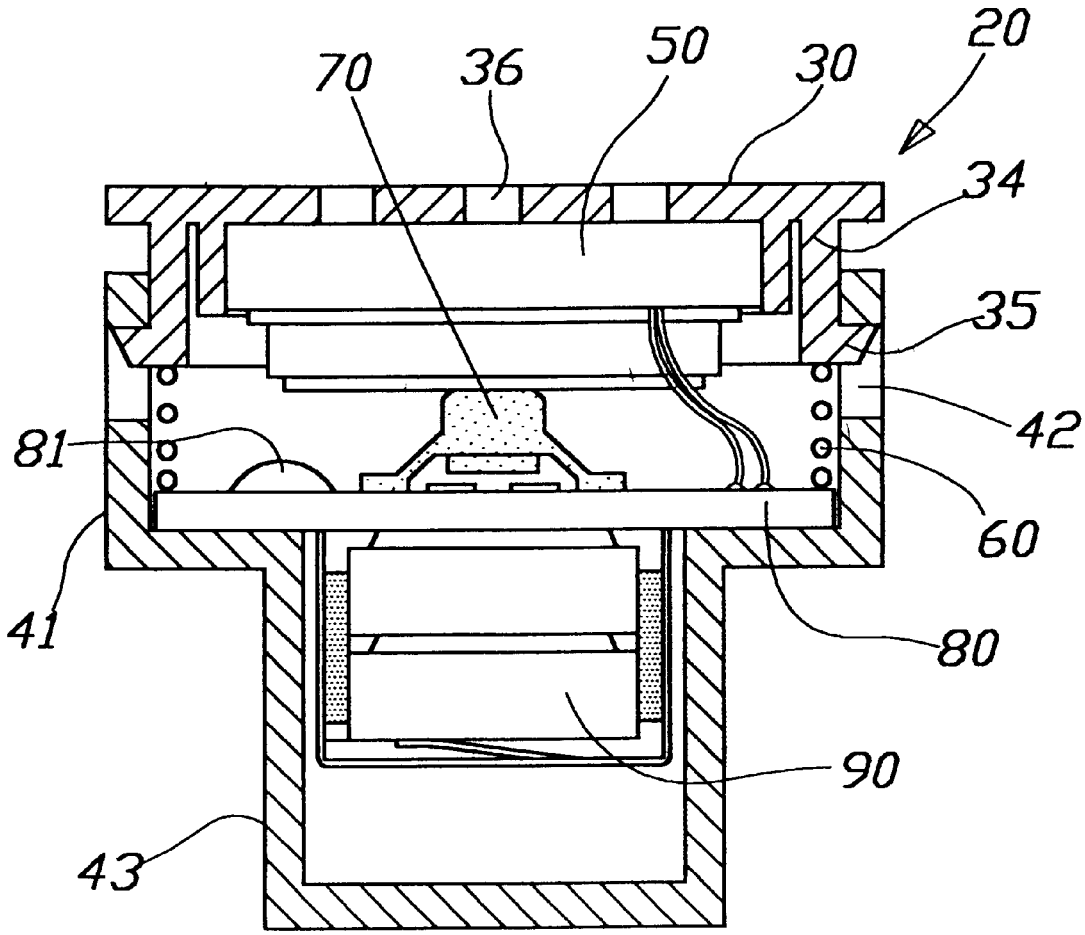
FIG. 4 is an assembled sectional view of the vocal assembly of the vocal container cap of the present invention.

The spring 60 is located between the lower periphery edge 33 of the movable member 30 and the circuit board 80 to normally push the movable member 30 upward against the cap portion 10 for the hooks 35 of the suspended tongues 34 to press against an upper edge of the windows 42 on the fixed member 40 while the mini speaker 50 presses a bottom thereof against an upper end of the elastic switch 70, as shown in FIG. 4.

Please refer to FIG. 2 again. When the cap portion 10 with the vocal assembly 20 received therein is fully closed onto a mouth 102 of a container 100, such as a wine bottle, the threaded section 12 of the cap portion 10 is screwed to an external threaded section 101 outside the mouth 102, the plunger portion 43 of the fixed member 40 is firmly pressed against the mouth 102, the hooks 35 of the movable member 30 are lowered from the upper edges of the windows 42 by a small distance a, the elastic switch 70 is in a lowered position to touch the contact 82, and the spring 60 is in a compressed state. This fully closed state of the cap portion 10 is defined as a first position of the vocal container cap of the present invention in which the vocal container cap is disabled.

Figure 5:
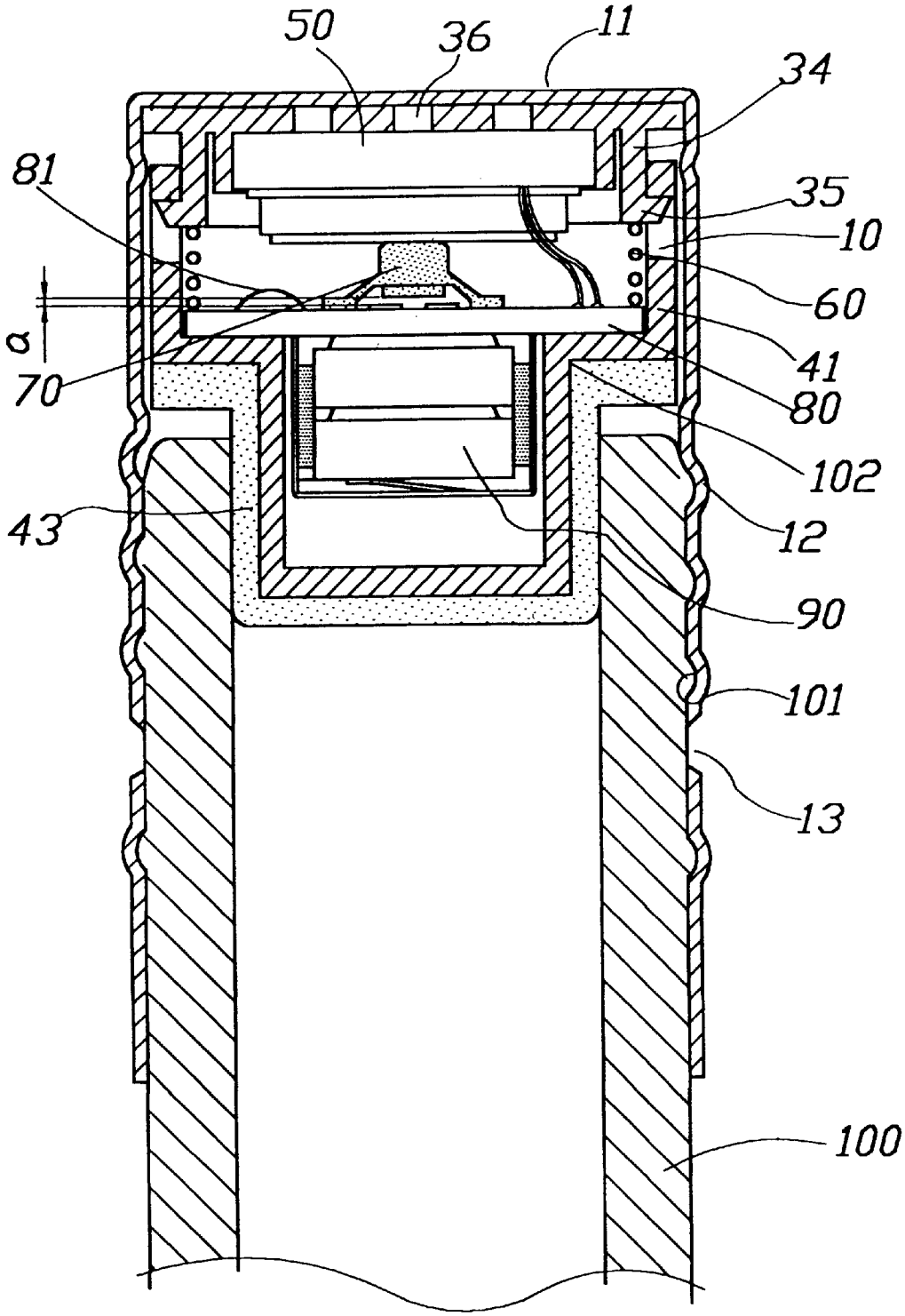
FIG. 5 is another assembled sectional view of the vocal container cap of the present invention, wherein the cap has been twisted apart to loosely close onto the container mouth and the vocal assembly thereof is actuated.

Please refer to FIG. 5. When the cap portion 10 is twisted relative to the mouth 102 of the container 100, it is broken at the weakened section 13 and allowed to move upward. At this point, a restoring force of the compressed spring 60 lifts the movable member 30 to separate the elastic switch 70 from the contact 82 by a predetermined distance a and complete one push of the elastic switch 70. As a result, a piece of music or voice greetings or congratulations are sounded for a predetermined period of time under control of the IC 81.

With the sound or voice given out of the vocal container cap when the latter is loosened from the mouth of the container, the otherwise monotonous movement of opening a bottle becomes interesting and joyful.

What is claimed is:

1. A vocal container cap comprising a hollow cap portion having a predetermined length to define a solid top and an open bottom, and a vocal assembly fitted in said hollow cap portion;

said cap portion being provided at a distance below said solid top with a threaded section for engaging with external screw threads provided around a container mouth, and below said threaded section with a circle of weakened section for easily breaking said cap portion thereat when said cap portion is twisted relative to said container mouth; and said vocal assembly including a fixed member, a movable member located above and associated with said fixed member, and a mini speaker, an elastic switch, a circuit board, and batteries sequentially mounted between said movable and said fixed members from top to bottom, and a spring located between said movable member and said circuit board;

said fixed member including a hollow ring portion having a plurality of windows spaced along a peripheral wall thereof, and a hollow plunger portion downward extended from a bottom of said ring portion for inserting into and sealing said container mouth; and said movable member including a diameter-reduced peripheral wall portion adapted to locate in said hollow ring portion of said fixed member and provided with a plurality of suspended tongues corresponding to said windows on said fixed member, such that a hook at a lower end of each said tongue outward projects into one said window and is normally pressed by said spring against an upper edge of said window;

said cap portion with said vocal assembly received therein and fully closed onto said container mouth being located at a first position in which said spring between said mini speaker and said circuit board is compressed, said hooks of said movable member are lowered from said upper edges of said windows on said fixed member by a predetermined distance, and said vocal container cap is disabled; and said cap portion with said vocal assembly received therein and broken at said weakened section to loosen from said container mouth being located at a second position in which said spring lifts said movable member to actuate said vocal container cap.

2. The vocal container cap as claimed in claim 1, wherein said spring is located between a lower periphery edge of said reduced peripheral wall portion and said circuit board.

3. The vocal container cap as claimed in claim 1, wherein said mini speaker is located in said diameter-reduced peripheral wall portion of said movable member with a bottom of said mini speaker pressed against an upper end of said elastic switch, and said elastic switch having a lower end facing toward a contact provided on said circuit board.

* * * * *